US005494885A

United States Patent [19]

Kudo et al.

[11] Patent Number: 5,494,885

[45] Date of Patent: Feb. 27, 1996

[54] PROTECTIVE LAYER TRANSFER FILM AND IMAGE-PRINTED MATTER

[75] Inventors: Mikiko Kudo; Katsuyuki Oshima; Hitoshi Saito, all of Tokyo, Japan

[73] Assignee: Dai Nippon Printing Co., Ltd., Japan

[21] Appl. No.: 390,953

[22] Filed: Feb. 21, 1995

[30] Foreign Application Priority Data

Feb. 21, 1994 [JP] Japan ..... 6-44734

[51] Int. Cl.[6] ..... B41M 5/035; B41M 5/38

[52] U.S. Cl. ..... 503/227; 428/195; 428/500; 428/913; 428/914

[58] Field of Search ..... 8/471; 428/195, 428/500, 913, 914; 503/227

[56] References Cited

FOREIGN PATENT DOCUMENTS 62-214990 9/1987 Japan ..... 503/227

*Primary Examiner*—B. Hamilton Hess

*Attorney, Agent, or Firm*—Parkhurst Wendel & Rossi

[57] ABSTRACT

A protective layer transfer film comprising a substrate film, and a thermally-transferable resin layer provided thereon, which comprises a resin combined with a reactive ultraviolet-absorbing agent by reaction.

7 Claims, 1 Drawing Sheet

PROTECTIVE LAYER TRANSFER FILM AND IMAGE-PRINTED MATTER

BACKGROUND OF THE INVENTION

The present invention relates to a heat transfer film, in particular, a protective layer transfer film in which a protective layer is transferred thermally, and, more specifically, to a protective layer transfer film capable of imparting durability such as resistance to light, weather, abrasion, chemicals and solvent to an image produced by means of heat transfer printing or the like.

Heretofore, a variety of heat transfer printing methods have been widely used as simple methods of printing. These heat transfer printing methods can easily produce images of various kinds, so that they have been conveniently utilized to make those printed matters whose number of printing is relatively small, such as ID cards.

Further, when a colored image is desirable as in the case of a photograph of face, there has been employed a heat transfer printing method using a heat transfer printing film which is obtained by sequentially providing areas of heat transfer coloring layers of yellow, magenta, cyan, and, if necessary, black on a continuous base film, a set of these sequential areas being repeatedly provided.

Heat transfer printing films of the above type can be broadly divided into two types: a heat transfer printing film of the so-called hot-melt transfer type whose heat transfer printing layer is softened by the image-wise application of heat and transferred to an image-receiving material, whereby an image is recorded on the image-receiving material; and a heat transfer printing film of the so-called sublimation transfer type in which a dye contained in its heat transfer printing layer is sublimed (migrated) by the application of heat and only the dye is transferred to an image-receiving material, whereby an image is formed on the image-receiving material.

However, it is not suitable to make ID cards or the like by the use of the above heat transfer printing films. For example, a heat transfer printing film of the hot-melt transfer type has such a shortcoming in that although it can readily produce images of letters, numbers or the like, the images produced are poor in durability, especially in abrasion resistance.

On the other hand, a heat transfer printing film of the sublimation transfer type has a shortcoming in that although it can precisely produce an image having gradation such as a photograph of face, the image produced is poor in durability such as resistance to light, weather and abrasion because the image contains no vehicle unlike an image printed by using an ordinary printing ink.

For example, a method in which an ultraviolet-absorbing agent or an antioxidant is incorporated has been known as a method for overcoming the above-described shortcomings. The light resistance and the like of the printed images can be improved to a certain extent even by such a method. However, a method in which an ultraviolet-absorbing agent is simply incorporated into a resin used for forming a protective layer has such a problem in that the effect of the ultraviolet-absorbing agent is decreased with time because the agent is volatilized or decomposed by heat. Japanese Laid-Open Patent Publication No. 212974/1993 discloses, as a method for solving this problem, a method in which a reactive ultraviolet-absorbing agent is reacted and combined with a resin used for forming the dye-receiving layer of a heat transfer image-receiving sheet. However, a dye which migrates when heat is applied and produces an image in the sublimation transfer printing process exists relatively near the surface of the dye-receiving layer, so that it is not effective to entirely impart ultraviolet-absorptivity to the dye-receiving layer. Moreover, there has been a problem in that when the amount of the ultraviolet-absorbing agent is increased, the properties inherent in the resin of the dye-receiving layer are impaired, and other properties are also marred, for instance, the image produced is spread.

SUMMARY OF THE INVENTION

An object of the present invention is therefore to solve the aforementioned problems in the prior art, thereby providing a protective layer transfer film excellent in the properties of imparting durability, especially light resistance to a heat-transferred image and maintaining it for a prolonged period of time, and image-printed matter having improved durability, obtained by the use of the protective layer transfer film.

We found that when an ultraviolet-absorbing agent is combined with a resin by reaction, the ultraviolet-absorbing effect of the agent can be maintained for a long time. The present invention has been accomplished by applying this finding to the thermally-transferable resin layer of a protective layer transfer film.

The first invention of the present invention is a protective layer transfer film comprising a substrate film, and a thermally-transferable resin layer provided thereon, which comprises a resin combined with a reactive ultraviolet-absorbing agent by reaction.

In a preferred embodiment of the present invention, the above-described resin combined with a reactive ultraviolet-absorbing agent by reaction is a copolymer of a reactive ultraviolet-absorbing agent represented by the following general formula (I):

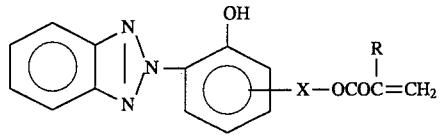

(I)

wherein R is H or $CH_3$, and X is $—CH_2CH_2—$ or $$—CH_2\underset{\underset{OH}{|}}{C}HCH_2—,$$

or by the formula (II):

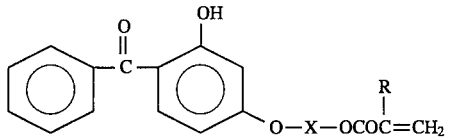

(II)

wherein R is H or $CH_3$, and X is $—CH_2CH_2—$ or $$—CH_2\underset{\underset{OH}{|}}{C}HCH_2—$$

and at least one of thermoplastic resin monomers and oligomers, and reactive polymers.

In another embodiment of the present invention, the above-described copolymer is a copolymer of the reactive ultraviolet-absorbing agent and at least one of acrylic monomers, oligomers and reactive polymers.

In another embodiment of the present invention, the above-described thermally-transferable resin layer is a laminate composed of a transparent resin layer and a thermally-adhesive resin layer which are laminated on the substrate film in the mentioned order, and at least one of these resin layers comprises the resin combined with a reactive ultraviolet-absorbing agent by reaction.

In another embodiment of the present invention, an ultraviolet-screening layer comprising the resin combined with a reactive ultraviolet-absorbing agent by reaction is provided between the above-described transparent resin layer and thermally-adhesive resin layer.

The second invention of the present invention is image-printed matter comprising an image-receiving material containing at least an image colored with a dye on its surface, and the thermally-transferable resin layer of the protective layer transfer film according to the first invention, which is laminated on at least a part of the image-printed surface of the image-receiving material.

Further, in another embodiment of the present invention, a sublimable dye layer and/or a thermal fusing ink layer can also be formed on the substrate film side by side together with the thermally-transferable resin layer.

In the protective layer transfer film of the present invention and the image-printed matter obtained by using the same, a resin combined with an ultraviolet-absorbing agent by reaction is incorporated into at least one of the layers which are constituting the thermally-transferable resin layer. Therefore, the ultraviolet-absorbing agent is hardly vaporized, volatilized or decomposed by heat, and the ultraviolet-absorbing effect can thus be maintained for a prolonged period of time. In particular, when the thermally-transferable resin layer of the protective layer transfer film of the present invention is transferred to and laminated on the image-printed surface of an image-receiving material, having a dye image formed by means of sublimation transfer printing, improved resistance to light as well as improved resistance to abrasion and scratch can be imparted to the image.

DETAILED DESCRIPTION OF THE INVENTION

Preferred embodiments of the present invention will now be explained by referring to the accompanying drawings.

FIGS. 1, 2, 3 and 4 are diagrammatic sectional views, each explaining an example of the protective layer transfer film of the present invention.

Figure 1:
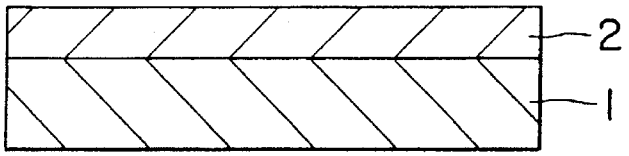
FIG. 1 is a diagrammatic sectional view explaining one example of the protective layer transfer film of the present invention.

FIG. 1 shows an example of the most simple structure of the layers. The structure is such that a thermally-transferable resin layer (transferable protective layer) 2 which contains a resin combined with a reactive ultraviolet-absorbing agent by reaction is provided as a single layer on one surface of a substrate film 1.

Figure 2:
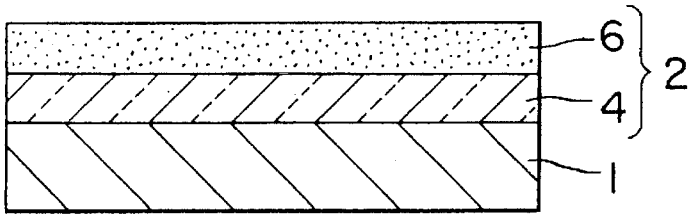
FIG. 2 is a diagrammatic sectional view explaining another example of the protective layer transfer film of the present invention.

FIG. 2 shows a structure in which a thermally-transferable resin layer 2 consisting of two layers, a transparent resin layer 4 and a thermally-adhesive resin layer 6, is provided on one surface of a substrate film 1. In this case, the resin layers 4 and 6 are laminated on the substrate film 1 in the mentioned order; and a resin combined with a reactive ultraviolet-absorbing agent by reaction is incorporated into either one of these two resin layers.

Figure 3:
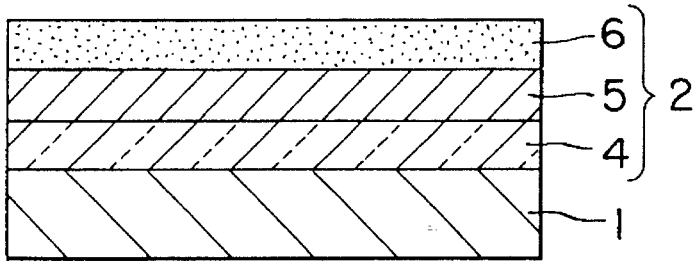
FIG. 3 is a diagrammatic sectional view explaining a further example of the protective layer transfer film of the present invention.

FIG. 3 shows a structure in which a thermally-transferable resin layer 2 consisting of three layers, a transparent resin layer 4, an ultraviolet-screening layer 5 and a thermally-adhesive resin layer 6, is provided on one surface of a substrate film 1. In this case, the three layers 4, 5 and 6 are laminated on the substrate film 1 in the mentioned order; and a resin combined with a reactive ultraviolet-absorbing agent by reaction is incorporated, of course, into the ultraviolet-screening layer 5.

Figure 4:
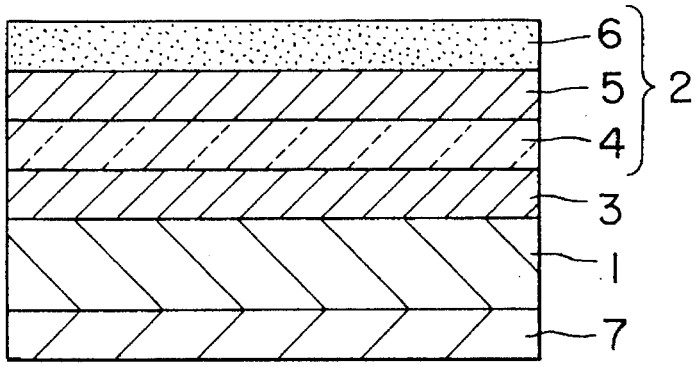
FIG. 4 is a diagrammatic sectional view explaining a still further example of the protective layer transfer film of the present invention.

FIG. 4 shows a structure in which a releasing layer 3, a transparent resin layer 4, an ultraviolet-screening layer 5 and a thermally-adhesive resin layer 6 are successively laminated on one surface of a substrate film 1 in the mentioned order, and a back layer 7 capable of imparting heat resistance and slipperiness to the protective layer transfer film is provided on the other surface of the substrate film 1.

The back layer 7 acts to prevent the protective layer transfer film from sticking to the thermal head of a printer. This layer can also be provided, when necessary, to the protective layer transfer films whose structures are shown in FIGS. 1 to 3, although it is not shown in the figures. Of course, it is not necessary to provide the back layer when the substrate film has excellent heat resistance and slipperiness.

The releasing layer 3 is provided to decrease the adhesion between the transparent resin layer 4 and the substrate film 1 when the release properties between them is insufficient so that the transparent resin layer 4 can be readily released from the substrate film 1. This layer can also be provided, when necessary, to the protective layer transfer films whose structures are shown in FIGS. 1 to 3, although it is not shown in the figures. Of course, it is not necessary to provide the releasing layer 3 when the release properties between the substrate film 1 and the transparent resin layer 4 is sufficient.

In the case where the releasing layer 3 is provided, it is necessary that the thermally-transferable resin layer 2 containing the transparent resin layer 4 can be released from the releasing layer 3 when it is thermally transferred, while the releasing layer 3 itself can remain on the substrate film.

Explanations on materials and a method of production of the protective layer transfer film of the present invention and those of image-printed matter obtainable by the use of the same will be given below.

First of all, the resin combined with a reactive ultraviolet-absorbing agent by reaction, incorporated into the thermally-transferable resin layer of the protective layer transfer film of the present invention will be explained.

The reactive ultraviolet-absorbing agent used in the present invention is one which is obtained by introducing an addition-polymerizable double bond such as a vinyl, acryloyl or methacryloyl group, or an alcoholic hydroxyl, amino, carboxyl, epoxy or isocyanate group to a non-reactive ultraviolet-absorbing agent such as a salicylate, benzophenone, benzotriazole, substituted acrylonitrile, nickel chelate or hindered amine based ultraviolet-absorbing agent, which is a conventionally-known organic ultraviolet-absorbing agent. Specific examples of the reactive ultraviolet-absorbing agent which can be favorably used in the present invention are the compounds represented by the following formulas (I) and (II), but the agent is not limited to these compounds:

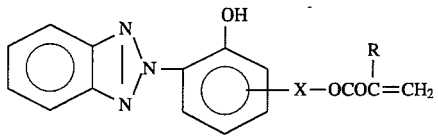

(I)

wherein R is H or $CH_3$, and X is $—CH_2CH_2—$ or $$—CH_2\underset{\underset{OH}{|}}{C}HCH_2—,$$ and

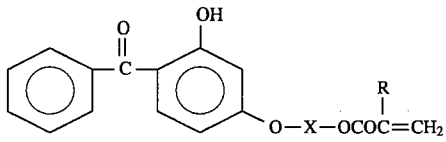

(II)

wherein R is H or $CH_3$, and X is $—CH_2CH_2—$ or $$—CH_2\underset{\underset{OH}{|}}{C}HCH_2—.$$

Various methods can be employed in order to fix the above reactive ultraviolet-absorbing agent by reaction. For example, a copolymer of the present invention can be obtained by radical polymerization of a resin component such as a conventionally-known monomer, oligomer or reactive polymer and the above-described reactive ultraviolet-absorbing agent. In this case, it is preferable to use a reactive ultraviolet-absorbing agent which contains an addition-polymerizable double bond, such as the above compound (I) or (II).

Further, when the reactive ultraviolet-absorbing agent contains a hydroxyl, amino, carboxyl, epoxy or isocyanate group, it can be reacted with and fixed to a thermoplastic resin having a functional group which is reactive with the above reactive group, by the application of heat or the like, optionally in the presence of a catalyst.

In the present invention, a polymer having ultraviolet-absorptivity is obtained by copolymerizing the above-described reactive ultraviolet-absorbing agent and a resin component such as a monomer, oligomer or reactive polymer, and the polymer obtained is incorporated into the thermally-transferable resin layer, or a layer of the polymer is laminated to obtain the thermally-transferable resin layer.

Examples of the monomer component which is copolymerized with the above reactive ultraviolet-absorbing agent include the following:

Methyl acrylate, methyl methacrylate, ethyl acrylate, ethyl methacrylate, propyl acrylate, propyl methacrylate, butyl acrylate, butyl methacrylate, isobutyl acrylate, isobutyl methacrylate, tert-butyl acrylate, tert-butyl methacrylate, isodecyl acrylate, isodecyl methacrylate, lauryl acrylate, lauryl methacrylate, lauryltridecyl acrylate, lauryltridecyl methacrylate, tridecyl acrylate, tridecyl methacrylate, cerylstearyl acrylate, cerylstearyl methacrylate, stearyl acrylate, stearyl methacrylate, ethylhexyl acrylate, ethylhexyl methacrylate, octyl acrylate, octyl methacrylate, cyclohexyl acrylate, cyclohexyl methacrylate, benzyl acrylate, benzyl methacrylate, methacrylic acid, hydroxyethyl acrylate, hydroxyethyl methacrylate, hydroxypropyl acrylate, hydroxypropyl methacrylate, dimethylaminoethyl acrylate, dimethylaminoethyl methacrylate, diethylaminoethyl acrylate, diethylaminoethyl methacrylate, tert-butylaminoethyl acrylate, tert-butylaminoethyl methacrylate, glycidyl acrylate, glycidyl methacrylate, tetrahydrofurfuryl acrylate and tetrahydrofurfuryl methacrylate; and ethylene diacrylate, ethylene dimethacrylate, diethylene glycol diacrylate, diethylene glycol dimethacrylate, triethylene glycol diacrylate, triethylene glycol dimethacrylate, tetraethylene glycol diacrylate, tetraethylene glycol dimethacrylate, decaethylene glycol diacrylate, decaethylene glycol dimethacrylate, pentadecaethylene glycol diacrylate, pentadecaethylene dimethacrylate, pentacontahectaethylene glycol diacrylate, pentacontahectaethylene glycol dimethacrylate, butylene diacrylate, butylene dimethacrylate, aryl acrylate, aryl methacrylate, trimethylolpropane triacrylate, trimethylolpropane trimethacrylate, hexanediol diacrylate, hexanediol dimethacrylate, tripropylene glycol diacrylate, tripropylene glycol dimethacrylate, pentaerythritol tetraacrylate, pentaerythritol tetramethacrylate, dipentaerythritol hexaacrylate, dipentaerythritol hexamethacrylate, 1,6-hexanediol diacrylate, 1,6-hexanediol dimethacrylate, neopentyl glycol pentaacrylate, neopentyl glycol pentamethacrylate, phosphazene hexaacrylate and phosphazene hexamethacrylate.

The above-enumerated materials can be used not only as monomers but also as oligomers. Further, acrylic reactive polymers such as polyester acrylate, epoxy acrylate, urethane acrylate and polyether acrylate polymers which are the polymers of the above-enumerated materials, or the derivatives thereof can also be used.

These monomers, oligomers and acrylic reactive polymers can be used either singly or as a mixture thereof.

A thermoplastic copolymeric resin combined with the reactive ultraviolet-absorbing agent by reaction can be obtained by copolymerizing the above-described thermoplastic resin monomer or l¥oligomer, or acrylic reactive polymer and the reactive ultraviolet-absorbing agent. The amount of the reactive ultraviolet-absorbing agent contained in the copolymeric resin is properly in the range of 10% to 90% by weight, and preferably in the range of 30% to 70% by weight. When this amount is less than 10% by weight, light resistance cannot be satisfactorily imparted to an image. On the other hand, when the amount is in excess of 90% by weight, some troubles are caused; for example, the resin becomes sticky, and a dye image is spread when the resin layer is transferred to the surface of the image.

Further, the molecular weight of this copolymeric resin is preferably about 5,000 to 250,000, and more preferably about 9,000 to 30,000. When the molecular weight of the resin is less than 5,000, a film obtained from the resin is weak, and cannot have sufficient durability as a protective layer. On the other hand, when the molecular weight of the resin is in excess of 250,000, the protective layer cannot be neatly transferred to the surface of an image by a thermal head or the like.

One example of the structural formula of the thermoplastic copolymeric resin obtainable by the copolymerization of the above-described reactive ultraviolet-absorbing agent and resin component is as follows, but, of course, the copolymeric resin is not limited to the following:

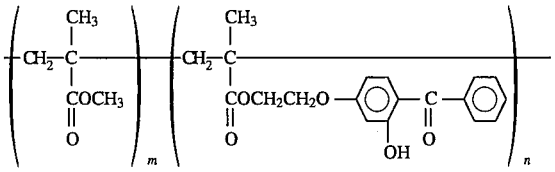

wherein m is from 10% to 90% by weight, and n is from 90% to 10% by weight.

Explanations on the substrate film and the other layers will be given below.

1) Substrate Film

A substrate film which has been used in the conventional heat transfer printing films can be used as it is as the substrate film 1 of the protective layer transfer film of the present invention. In addition, a film whose surface is imparted with adhesiveness, or the like can also be used. Any film can thus be used as the substrate film 1 in the present invention.

Specific examples of a preferable substrate film include plastic films of polyester (e.g. polyethylene terephthalate), polycarbonate, polyamide, polyimide, cellulose acetate, polyvinylidene chloride, polyvinyl chloride, polystyrene, fluororesins, polypropylene, polyethylene and ionomers; papers such as glassine paper, condenser paper and paraffin paper; and cellophane. In addition, composite films obtained by laminating two or more of these films and papers can also be mentioned.

The thickness of the substrate film 1 is changed depending upon the material thereof so that the substrate film can have proper strength and heat resistance. In general, however, the thickness of the substrate film is preferably about 3 to 100 μm.

2) Releasing Layer

In general, a protective layer transfer film is prepared by providing a thermally-transferable resin layer 2 on one surface of the substrate film 1. However, depending upon the combination of the materials of the substrate film 1 and the thermally-transferable resin layer 2, there may be a case where the release properties between the substrate film 1 and the thermally-transferable resin layer 2 are insufficient when the resin layer 2 is thermally transferred. In such a case, a releasing layer 3 can be provided on the surface of the substrate film 1 in advance (FIG. 4).

One or more materials selected from waxes, silicone waxes, silicone resins, fluororesins, acrylic resins, polyvinyl alcohol resins, urethane resins and cellulose resins such as cellulose acetate and the like can be used for forming the releasing layer 3. When two or more of these materials are blended, a proper water-soluble resin may also be used. The releasing layer can be formed in such a manner in that a coating liquid containing as its main component(s) the above material(s) is coated onto one surface of a substrate film by a conventional method such as the gravure coating method or the gravure reverse coating method, and then dried. It is sufficient that the thickness of the releasing layer be approximately 0.1 to 2 μm.

The following points should be taken into consideration when the materials used for forming the releasing layer are selected. It is, of course, necessary that proper releasing properties can be obtained between the releasing layer and the thermally-transferable resin layer. In addition, it is important to make the adhesion between the releasing layer and the substrate film higher than the adhesion between the releasing layer and the thermally-transferable resin layer. This is because insufficient adhesion between the releasing layer and the substrate film brings about abnormal transfer, for example, the releasing layer is entirely transferred together with the protective layer.

When it is favorable that image-printed matter have a mat protective layer on its surface, it is possible to incorporate various kinds of particles into the releasing layer. Alternatively, mat image-printed matter protected by a protective layer can be obtained by the use of a substrate film whose surface on which the releasing layer will be provided is made mat.

3) Thermally-Transferable Resin Layer

The thermally-transferable resin layer 2 of the protective layer transfer film of the present invention is thermally transferred to the image-printed surface of an image-receiving sheet, whereby a protective layer is formed on the image-printed surface. Therefore, the thermally-transferable resin layer 2 should have the following functions: it can be neatly released from the substrate film 1 or the releasing layer 3 provided thereon with certainty when it is thermally transferred to the image-printed surface; it has high thermal adhesion to the image-receiving sheet; it can impart, as a protective layer, durability such as resistance to abrasion and scratch, especially excellent light resistance to the image-printed surface; and it has high transparency, and does not impair the clearness of the image printed on the image-receiving sheet.

Although the thermally-transferable resin layer 2 can be provided on a substrate film 1 as a single layer as shown in FIG. 1, it is also preferable to provide, on a substrate film 1, a thermally-transferable resin layer composed of multiple layers, that is, one composed of two layers, a transparent resin layer 4 and a thermally-adhesive resin layer 6, or one composed of three layers, a transparent resin layer 4, an ultraviolet-screening layer 5 and a thermally-adhesive resin layer 6, the layers 4 and 6, or 4, 5 and 6 being laminated on the substrate film in the mentioned order as shown in FIGS. 2 to 4. Explanations on these layers will be respectively given below.

3-1) Transparent Resin Layer

The transparent resin layer 4 to be provided on the above-described substrate film 1 or releasing layer 3, that is, one layer of the thermally-transferable resin layer 2, positioned on the substrate film side may be formed by the use of a resin which is excellent in abrasion resistance, transparency, hardness and the like. Examples of such a resin include polyesters, polystyrenes, acrylic resins, polyurethanes and acrylurethane resins; silicone-modified resins thereof; mixtures thereof; and those resins which are obtained by crosslinking and hardening at least one of the previously-mentioned polymerizable monomers and oligomers, and reactive polymers by the application of ionizing radiation. Further, the above-described hardening resin may be mixed with a thermoplastic resin which is compatible with it in order to improve the flexibility and adhesiveness of the transparent resin layer.

In the case where the resin is crosslinked and hardened by the application of ionizing radiation, an intermediate layer (primer layer) may be provided, by using an acrylic, urethane, polystyrene, acrylurethane or polyester resin, between the transparent resin layer and the ultraviolet-screening layer in order to enhance the adhesion between these layers.

Although the above-described resins are excellent in transparency, they tend to form layers which are relatively strong. Therefore, the layers cannot be neatly released from the substrate film when they are thermally transferred. In order to improve the peeling properties of the layers of these transparent resins, and to improve the abrasion and scratch resistance of the image-printed surface which is covered with the thermally-transferable resin layer, fine particles of silica, alumina, calcium carbonate or a plastic pigment, or a wax which is highly transparent can be added to the resins in such an amount that the transparency of the resins is not impaired. The amount of these fine particles is preferably 0.5 to 20 parts by weight to 100 parts by weight of the resin (solid). In addition, in order to further improve the resistance to abrasion and scratch, an additive such as a silicone-modified resin or a lubricant may be incorporated into the resins.

Gravure coating, gravure reverse coating, roll coating, or any other conventional means can be utilized to form the transparent resin layer 4. A coating liquid containing the above resin(s) is coated by such a method, and then dried to form the transparent resin layer. The thickness of this transparent resin layer 4 when dried is approximately 0.1 to 50 μm, preferably about 1 to 10 μm.

3-2) Ultraviolet-Screening Layer

In the present invention, the resin combined with a reactive ultraviolet-absorbing agent by reaction may be incorporated into the transparent resin layer 4 and/or the thermally-adhesive resin layer 6 when the thermally-transferable resin layer 2 is composed of multiple layers. However, it is possible to separately provide an ultraviolet-screening layer 5. In this case, the ultraviolet-screening layer can be provided at any position, for example, between the transparent resin layer 4 and the thermally-adhesive resin layer 6, or between the substrate film 1 or the releasing layer 3 and the transparent resin layer 4. In general, however, it is preferable that the ultraviolet-screening layer 5 be provided between the transparent resin layer 4 and the thermally-adhesive resin layer 6. The ultraviolet-screening layer 5 may be formed by the same method as in the formation of the above-described transparent resin layer. It is sufficient that the thickness of the ultraviolet-screening layer be approximately 0.1 to 5 μm.

3-3) Thermally-Adhesive Resin Layer

The thermally-adhesive resin layer 6 may be provided as an uppermost layer in order to fix the above-described layers on an image-printed surface with high adhesion. Those resins which show high adhesion when heated, such as acrylic, vinyl chloride, vinyl acetate, vinyl chloride-vinyl acetate copolymeric, styrene-acryl copolymeric, polyester and polyamide resins can be used for forming the thermally-adhesive resin layer 6. An emulsion of a styrene-acryl copolymer can also be favorably used. The thermally-adhesive resin layer 6 can be formed in such a manner in that a liquid solution or emulsion containing one or more of the above resins is coated by the same method as in the formation of the above-described transparent resin layer, and then dried. The thickness of the thermally-adhesive resin layer 6 is preferably in the range of about 0.1 to 5 μm.

4) Back Layer

In the protective layer transfer film of the present invention, a back layer 7 (heat-resistant slippery layer) can be provided on the surface of the substrate film opposite to the surface on which the thermally-transferable resin layer 2 is provided, in order to prevent the protective layer transfer film from sticking to the thermal head of a printer, or a thermal plate used for the heat transfer of the protective layer, and to improve the slipperiness of the protective layer transfer film (see FIG. 4). A conventionally-known resin such as a butyral resin or the like hardened by an isocyanate compound, or a silicone resin can be used as it is for forming the back layer 7. It is sufficient that the thickness of the back layer be approximately from 0.1 to 5 μm. A primer layer may be provided between the back layer and the substrate film, if necessary.

(Method for Producing Protective Layer Transfer Film, Method for Transferring Protective Layer, etc.)

The layers constituting the protective layer transfer film of the present invention have been respectively explained in the above. It is preferable that the total thickness of the thermally-transferable resin layer 2 be in the range of approximately 0.5 to 50 μm. The thermally-transferable resin layer 2 may be provided as a single layer on a substrate film to obtain a transfer film containing a protective layer only. It is, however, also possible to obtain a transfer film which contains both a protective layer and an ink layer by sequentially providing an area of the protective layer, and an area of a sublimable-dye or carbon-containing ink layer on a substrate film.

In this case, the protective layer and the ink layer can be provided in any area pattern. However, the following patterns can be mentioned as examples; such a pattern is repeatedly provided on a substrate film to obtain a transfer film containing both the protective layer and the ink layer.

(a) Yellow dye layer, magenta dye layer, cyan dye layer, protective layer (b) Yellow dye layer, magenta dye layer, cyan dye layer, black dye layer, protective layer (c) Yellow dye layer, magenta dye layer, cyan dye layer, hot-melt black ink layer, protective layer (d) Black dye layer, protective layer (e) Hot-melt black ink layer, protective layer In the above area patterns, the areas of the black dye layer, the hot-melt black ink layer and the protective layer may be made larger than those of the other layers.

As materials for the above-mentioned ink layer and the method for forming the ink layer, known materials and conventional method can be employed therefor.

Since the resin for forming the thermally transferable resin layer is transparent, an additive such as an optical whitening agent may be added in the thermally transferable resin layer in order to adjust a coating position to a predetermined position.

A detection mark may be provided on any of the above layers. For instance, it may be provided at the top of the area of each layer, or at the top of the first color area.

An image to be protected by using the protective layer transfer film is one which is formed, in general, by the sublimation-type heat transfer printing method and/or the hot-melt-type heat transfer printing method. However, the protective layer transfer film of the present invention can be applied not only to such an image but also to an image obtained by any other method.

When the protective layer transfer film is applied to an image obtained by means of sublimation-type heat transfer printing, not only a protective layer is formed on the image, but also the color of a dye with which the image is produced is developed again by the heat applied when the protective layer is transferred. Therefore, the image becomes more clear.

Further, an image produced by means of sublimation-type heat transfer printing and/or hot-melt-type heat transfer printing, on any image-receiving material such as an image-receiving sheet or card whose base is a sheet of a plastic such as a polyester resin, a vinyl chloride resin, a vinyl chloride-vinyl acetate copolymeric resin or polycarbonate is acceptable. For example, a heat transfer image-receiving sheet which is prepared by providing a resin layer (image-receiving layer) having dye-receptivity on a base sheet, or a film, sheet or molded product which is obtained by the use of a resin having dye-receptivity can be used as the image-receiving material.

Examples of the resin having dye-receptivity include polyolefin resins such as polypropylene, halogenated polymers such as polyvinyl chloride and polyvinylidene chloride, vinyl polymers such as polyvinyl acetate and polyacryl ester, polyester resins such as polyethylene terephthalate and polybutylene terephthalate, polystyrene resins, polyamide resins, copolymeric resins of an olefin such as ethylene or propylene and other vinyl monomer, ionomers, cellulose resins such as cellulose diacetate, cellulose triacetate, and polycarbonates. A lubricant such as silicone oil or the like may be added to the above resins in order to prevent the fusion between the image-receiving layer and the heat transfer printing sheet.

Any of the following materials can be used as the sheeted base:

(1) synthetic paper (polyolefin type, polystyrene type);

(2) high quality paper, art paper, coated paper, cast-coated paper, wall paper, backing paper, paper impregnated with a synthetic resin or emulsion, paper impregnated with a synthetic rubber latex, paper internally-added with a synthetic resin, cardboard, natural fiber paper such as cellulose fiber paper; and (3) a film or sheet of various plastics such as polyolefin, polyvinyl chloride, polyethylene terephthalate, polystyrene, methyl methacrylate and polycarbonate.

Of these, synthetic paper listed in the above item (1) is preferable because it has a micro-void foil having a low thermal conductivity (in other words, high heat-insulating properties) on its surface. Further, a laminate composed of any of the materials listed in the above items (1) to (3) can also be used. Examples of the typical laminate include a laminate of cellulose fiber paper and synthetic paper, and a laminate of cellulose fiber paper and a plastic film or sheet.

Materials of the card which is used as an image-receiving material will be explained. A film or sheet of various plastics such as conventionally-known polyolefin, polyvinyl chloride, polyethylene terephthalate, polystyrene, polymethacrylate and polycarbonate can be used as the base of the card which is used as an image-receiving material in the present invention, as long as it is provided, on its surface, with a dye-receiving layer which is dyed with a sublimable dye. In addition, a white opaque film obtained from a mixture of the above synthetic resin and a white pigment or a filler, or an expanded sheet obtained by expanding the mixture can also be used. Moreover, synthetic paper (polyolefin type, polystyrene type), high quality paper, art paper, coated paper, cast-coated paper, wall paper, backing paper, paper impregnated with a synthetic resin or emulsion, paper impregnated with a synthetic rubber latex, paper internally-added with a synthetic resin, cardboard, cellulose fiber paper and the like can also be used. Any material can thus be used.

Further, a laminate obtained by using the above base films in any combination can also be used.

A preferable example of the card used in the present invention is one having such a structure in that transparent polyvinyl chloride layers are laminated on both surfaces of a center core made from polyvinyl chloride containing a white pigment. A suitable amount of a plasticizer is incorporated into at least the transparent polyvinyl chloride layer which serves as an image-receiving surface in order to impart thereto good dye-receptivity.

The amount of such a plasticizer is preferably in the range of 0.1 to 10 parts by weight, in particular, in the range of 3 to 5 parts by weight for 100 parts by weight of the polyvinyl chloride by which the dye-receiving surface is formed. When the amount of the plasticizer is too small, sublimable dye-receptivity is liable to be insufficient. On the other hand, when the amount of the plasticizer is too large, the dye-receiving surface is liable to lose its rigidity and to become soft, thereby to cause abnormal transfer, that is, the dye layer of a heat transfer printing sheet is wholly transferred to the dye-receiving surface when heat transfer printing is carried out.

A coloring pigment, a white pigment, an extender pigment, a filler, an ultraviolet-absorbing agent, an antistatic agent, a thermal stabilizer, an antioxidant, a fluorescent whitening agent or the like may also be optionally used in the above dye-receiving surface.

A magnetic recording layer, an embossed pattern or any other printed pattern, an optical memory, an IC memory or a bar code which is necessary may be provided, in advance, on the surface of the card. It is also possible to provide a magnetic recording layer or any of the above ones after information such as a photograph of face is formed on the card by the sublimation-type transfer printing method or the like.

A photograph of face can be formed on the above card by a conventional method, using the sublimation-type heat transfer printing sheet of the present invention. At this time, letter or bar code informations or the like can also be simultaneously formed on the card by the use of the sublimation-type heat transfer printing sheet. It is however preferable to form the informations by using a hot-melt-type heat transfer printing sheet which can produce a black-colored image having a high density.

A colored image and/or a letter image is formed on the above-described image-receiving sheet or card by a thermal printer, and a protective layer is then provided on the image-printed surface by transferring the thermally-transferable resin layer of the protective layer transfer film of the present invention. When the image and the protective layer are transferred, the thermal printer may be set for the conditions of sublimation transfer printing, those of hot-melt transfer printing, and those of the transfer of the protective layer, respectively. Alternatively, the image and the protective layer may be transferred by a common printer by suitably adjusting the printing energy.

The thermally-transferable resin layer of the protective layer transfer film of the present invention can be transferred not only by using, as a heating means, a thermal printer but also a thermal plate, a hot stamper, a thermal roller, a line heater, an iron or the like.

The protective layer may be transferred either to the entire surface of the image formed, or only to a specific part thereof.

Furthermore, the protective layer transfer film can also be applied as a pouching material which is a laminate sheet employed for, for example, menus used in restaurants, and a variety of cards. In this case, the ultraviolet-screening layer and the thermally-adhesive resin layer of the present invention are provided on one surface of a transparent substrate film or a commercially available laminate sheet to obtain a laminate sheet of the present invention. This laminate sheet is thermally adhered on the image which has been formed by the sublimation-type heat transfer printing method and/or the hot-melt-type heat transfer printing method.

The present invention will now be explained more specifically by referring to the following Examples and Comparative Examples. Throughout these examples, the unit "part(s)" means "part(s) by weight". (Preparation of Sublimation-Type Heat Transfer Printing Film)

Inks of three colors having the following formulations, each containing a sublimable dye were respectively prepared.

| | | |
|---|---|---|
| (1) | Formulation of Yellow Ink | |
| | Quinophthalone dye having the following structural formula: | 5.5 parts |

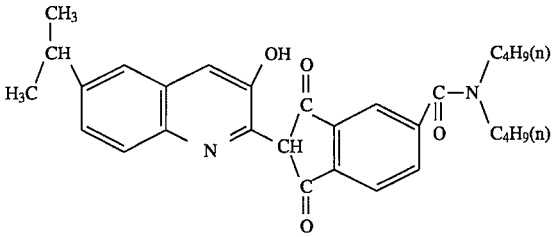

| | | |
|---|---|---|
| | Polyvinyl butyral ("Ethlec BX-1" manufactured by Sekisui Chemical Co., Ltd.) | 4.5 parts |
| | Methyl ethyl ketone/toluene (weight ratio 1:1) | 90.0 parts |
| (2) | Formulation of Magenta Ink | |
| | Magenta dye (C.I. Disperse Red 60) | 5.5 parts |
| | Polyvinyl butyral ("Ethlec BX-1" manufactured by Sekisui Chemical Co., Ltd.) | 4.5 parts |
| | Methyl ethyl ketone/toluene (weight ratio 1:1) | 90.0 parts |
| (3) | Formulation of Cyan Ink | |
| | Cyan dye (C.I. Solvent Blue 63) | 5.5 parts |
| | Polyvinyl butyral ("Ethlec BX-1" manufactured by Sekisui Chemucal Co., Ltd.) | 4.5 parts |
| | Methyl ethyl ketone/toluene (weight ratio 1:1) | 90.0 parts |

Areas of yellow, magenta and cyan inks were sequentially provided by coating the above-prepared ink compositions in the mentioned order by the gravure printing method onto a polyester film ("Lumirror" (trademark) manufactured by Toray Industries, Inc.) having a thickness of 6 μm, provided with a heat-resistant slippery layer having a thickness of 1 μm on its back surface, and a primer layer made from a urethane resin, having a thickness of 0.5 μm on its surface. The amount of each ink composition coated was approximately 3 g/m$^2$ (solid matter), and a set of the yellow, magenta and cyan ink areas was repeatedly provided every 15 cm on the polyester film in the direction of flow thereof. Thereafter, the ink compositions were dried to form a sublimable dye layer, whereby a sublimation-type heat transfer printing film was obtained.

EXAMPLE 1

A polyethylene terephthalate film ("Lumirror" (trademark) manufactured by Toray Industries, Inc.) having a thickness of 12 μm was used as a substrate film. A heat-resistant slippery layer having a thickness of 1 μm was formed, as a back layer, on one surface of the substrate film by using a silicone resin by the gravure coating method. Onto the other surface of the substrate film, a coating liquid for forming a transparent resin layer having the following formulation was coated in an amount of 3 g/m$^2$ on dry basis by the gravure coating method, and then dried to form a transparent resin layer.

| Formulation of Coating Liquid for Forming Transparent Resin Layer: | |
|---|---|
| Acrylic Resin ("Dianal BR-83" manufactured by Mitsubishi Rayon Engineering Co., Ltd.) | 20 parts |
| Methyl ethyl ketone/toluene (weight ratio 1:1, methyl ethyl ketone is hereinafter referred to as MEK) | 80 parts |

Onto the above transparent resin layer, a coating liquid for forming an ultraviolet-screening layer having the following formulation was coated in an amount of 1 g/m$^2$ on dry basis by the gravure coating method, and then dried to form an ultraviolet-screening layer.

| Formulation of Coating Liquid for Forming Ultraviolet-Screening Layer: | |
|---|---|
| Copolymeric resin combined with reactive ultraviolet-absorbing agent by reaction ("UVA-635L" manufactured by BASF JAPAN LTD.) | 20 parts |
| Ethyl acetate | 80 parts |

It is noted that the resin "UVA-635L" is a copolymeric resin represented by the following formula:

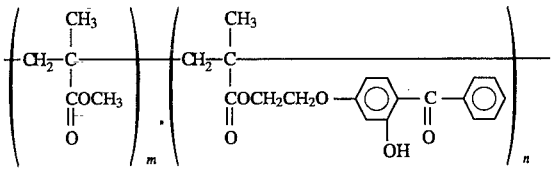

wherein m:n is 5:5 (weight ratio).

Further, onto the above ultraviolet-screening layer, a coating liquid for forming a thermally-adhesive resin layer having the following formulation was coated in an amount of 1 g/m$^2$ on dry basis by the gravure coating method, and then dried to form a thermally-adhesive resin layer. A protective layer transfer film of Example 1 was thus prepared.

| Formulation of Coating Liquid for Forming Thermally-Adhesive Resin Layer: | |
|---|---|
| Vinyl chloride-vinyl acetate copolymer ("#1000 ALK" manufactured by Denki Kagaku Kogyo K.K.) | 20 parts |
| MEK/toluene (weight ratio 1:1) | 80 parts |

EXAMPLE 2

A protective layer transfer film of Example 2 was prepared in the same manner as in Example 1 except that the formulation of the coating liquid used for forming the ultraviolet-screening layer was replaced by the following one.

| Formulation of Coating Liquid for Forming Ultraviolet-Screening Layer: | |
|---|---|
| Copolymeric resin combined with reactive ultraviolet-absorbing agent by reaction ("UVA-633L" manufactured by BASF JAPAN LTD.) | 20 parts |
| Ethyl acetate | 80 parts |

It is noted that the resin "UVA-633L" is a copolymeric resin represented by the following formula:

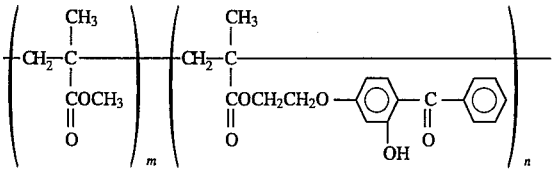

wherein m:n is 7:3.

EXAMPLE 3

A protective layer transfer film of Example 3 was prepared in the same manner as in Example 1 except that the ultraviolet-screening layer was not formed and that the formulation of the coating liquid used for forming the transparent resin layer was replaced by the following one.

| Formulation of Coating Liquid for Forming Transparent Resin Layer: | |
|---|---|
| Copolymeric resin combined with reactive ultraviolet-absorbing agent by reaction ("UVA-633L" manufactured by BASF JAPAN LTD.) | 20 parts |
| Ethyl acetate | 80 parts |

EXAMPLE 4

A protective layer transfer film of Example 4 was prepared in the same manner as in Example 1 except that the ultraviolet-screening layer was not formed and that the coating liquid used for forming the thermally-adhesive resin layer was replaced by a coating liquid having the following formulation.

| Formulation of Coating Liquid for Forming Thermally-Adhesive Resin Layer: | |
|---|---|
| Acrylic resin ("Dianal BR-90" manufactured by Mitsubishi Rayon Engineering Co., Ltd.) | 10 parts |
| Copolymeric resin combined with reactive ultraviolet-absorbing agent by reaction ("UVA-633L" manufactured by BASF JAPAN LTD.) | 20 parts |
| MEK/toluene (weight ratio 1:1) | 70 parts |

EXAMPLE 5

A protective layer transfer film of Example 5 was prepared in the same manner as in Example 1 except that the coating liquid used for forming the transparent resin layer was replaced by a coating liquid having the following formulation, containing an ionizing-radiation-hardening resin, that an intermediate layer was newly provided on the transparent resin layer by using a coating liquid having the following formulation so as to improve the adhesion between the transparent resin layer and the ultraviolet-screening layer provided thereon, and that the intermediate layer and the transparent resin layer were treated by the below-described method.

| Formulation of Coating Liquid for Forming Transparent Resin Layer: | |
|---|---|
| Dipentaerythritol hexaacrylate | 7.5 parts |
| Polymethyl methacrylate | 15.0 parts |
| MEK/toluene (weight ratio 1:1) | 77.5 parts |
| **Formulation of Coating Liquid for Forming Intermediate Layer:** | |
| Polymethyl methacrylate | 30 parts |
| MEK/toluene (weight ratio 1:1) | 70 parts |

The coating liquid for forming a transparent resin layer was coated onto the substrate film in an amount of 3 $g/m^2$ on dry basis by the gravure coating method, and then dried to form a transparent resin layer. Successively, the coating liquid for forming an intermediate layer was coated onto the transparent resin layer in an amount of 1 $g/m^2$ on dry basis by the gravure coating method, and then dried to form an intermediate layer. To this was then applied 5 Mrads of an electron beam accelerated to 175 kV from the coated-surface side under nitrogen gas atmosphere to crosslink and harden the two layers to finally obtain transparent films.

EXAMPLE 6

A protective layer transfer film of Example 6was prepared in the same manner as in Example 1 except that the formulation of the coating liquid used for forming the transparent resin layer was replaced by the following one.

| Formulation of Coating Liquid for Forming Transparent Resin Layer: | |
|---|---|
| Acrylic resin ("Dianal BR-83" manufactured by Mitsubishi Rayon Engineering Co., Ltd.) | 20 parts |
| Polyethylene wax (average particle size: 10 μm) | 1 part |
| MEK/toluene (weight ratio 1:1) | 80 parts |

EXAMPLE 7

A protective layer transfer film of Example 7 was prepared in the same manner as in Example 5 except that the formulation of the coating liquid used for forming the transparent resin layer was replaced by the following one.

| Formulation of Coating Liquid for Forming Transparent Resin Layer: | |
|---|---|
| Dipentaerythritol hexaacrylate | 7.5 parts |
| Polymethyl methacrylate | 15 parts |
| Polyethylene wax (average particle size: 10 μm) | 1.5 parts |
| Coroidal silica | 1.5 parts |
| MEK/toluene (weight ratio 1:1) | 77.5 parts |

EXAMPLE 8

(dye layer-integrated protective layer transfer film)

A polyethylene terephthalate film ("Lumirror" (trademark) manufactured by Toray Industries, Inc.) having a thickness of 6 μm was used as a substrate film. The following composition for forming a heat-resistant slippery layer was coated on one surface of the substrate film in an amount of 1.0 g/m$^2$ on dry basis by the gravure coating method, and dried and thermally aged in an oven at a temperature for 5 days to cure the layer.

| Formulation of Coating Liquid for Forming Heat-resistant Slippery Layer: | |
|---|---|
| Polyvinyl butyral resin ("Ethlec BX-1" manufactured by Sekisui Kagaku K.K.) | 3.6 parts |
| Polyisocyanate ("Barnock D750" manufactured by Dainippon Ink K.K.) | 8.4 parts |
| Phosphate surfactant ("Playsurf A208S" manufactured by Daiichi Seiyaku K.K.) | 2.8 parts |
| Talc ("Microace P-3" manufactured by Nippon Talc K.K.) | 0.6 part |
| MEK/toluene (weight ratio 1:1) | 190 parts |

Further, through a primer layer of a urethane resin, the afore-mentioned sublimable dye compositions of yellow, magenta and cyan were coated respectively on the surface where the heat-resistant slippery layer was not formed by means of a gravure coater. In this case, each dye layer was formed so as to make one set of three dye layers wherein each dye layer has a width of 15 cm. Each set of dye layers was formed on the substrate with a space of 30 cm.

Next, the following composition for a releasing layer was coated in an amount of 1 g/m$^2$ on dry basis by the gravure coating method on the portion where the dye layer is not formed, and then dried to form a releasing layer.

| Formulation of Coating Liquid for Forming Releasing Layer: | |
|---|---|
| Polyurethane resin ("Hydrorane AP-40" manufactured by Dainippon Ink K.K.) | 7.5 parts |
| Polyvinyl alcohol ("Gosenol C-500" manufactured by Nippon Gosei Kagaku K.K.) | 15 parts |
| Optical whitening agent ("Uvitex C.F." by Ciba-Geigy, Ltd.) | 0.1 part |
| Water/ethanol (weight ratio 1:1) | |

Further, the following coating composition for forming a releasable protective layer (1.0 g/m$^2$ on dry basis) and the following coating composition for forming a coloring layer (1.0 g/m$^2$ on dry basis) were coated on the portion of the releasing layer adjacent to the cyan dye layer, each of the releasable protective layer and the coloring layer having a length of 15 cm, and then dried to form a thermal fusing ink layer comprising a releasable protective layer and a coloring layer.

| Formulation of Coating Liquid for Forming Releasable Protective Layer: | |
|---|---|
| Acrylic resin ("BR-83" by Mitsubishi Rayon) | 88 parts |
| Polyethylene wax (average particle size: 10 μm) | 11.5 parts |
| Polyester ("Vylon 200" by Toyobo K.K.) | 0.5 part |
| Optical whitening agent ("Uvitex O.B." by Ciba-Geity, Ltd.) | 0.5 part |
| Toluene/MEK (1:1) | 300 parts |
| **Formulation of Coating Liquid for Forming Coloring Layer:** | |
| Vinyl chloride-Vinyl acetate copolymer resin | 60 parts |
| Carbon black | 40 parts |
| Toluene/MEK (weight ratio 1:1) | 200 parts |

Further, the following compositions for forming a transparent resin layer (2.0 g/m$^2$ on dry basis) and a primer layer (1.0 g/m$^2$ on dry basis) were coated on the releasing layer adjacent to the thermal fusing ink layer by the gravure coating method, and then dried to form each layer having a length of 15 cm.

| Formulation of Coating Liquid for Forming Transparent Resin Layer: | |
|---|---|
| Dipentaerythritol hexaacrylate | 10 parts |
| Polymethyl methacrylate | 20 parts |
| Silane coupling agent-treated silica | 3 parts |
| Polyethylene wax (average particle size: 10 μm) | 1 part |
| Optical whitening agent ("Uvitex O.B." by Ciba-Geigy, Ltd.) | 0.15 part |
| MEK/toluene (1:1) | 70 parts |
| **Formulation of Coating Liquid for Forming Primer Layer:** | |
| Polymethyl methacrylate | 30 parts |
| Optical whitening agent ("Uvitex O.B." by Ciba-Geigy, Ltd.) | 0.15 part |
| MEK/toluene (1:1) | 70 parts |

Further, an ultraviolet-screening layer (1.0 g/m$^2$ on dry basis) and an adhesive layer having the following formulations were formed respectively on the primer layer.

| Formulation of Coating Liquid for Forming Ultraviolet-screening Layer: | |
|---|---|
| Copolymer combined with a reactive ultraviolet-absorbing agent ("UVA-635L" by BASF JAPAN LTD.) | 20 parts |
| MEK/toluene (1:1) | 80 parts |
| **Formulation of Coating Liquid for Forming Thermally-Adhesive Resin Layer:** | |
| Vinyl chloride-vinyl acetate copolymer ("#1000 ALK" by Denki Kagaku Kogyo K.K.) | 30 parts |
| Optical whitening agent ("Uvitex O.B." by Ciba-Geigy, Ltd.) | 0.15 part |
| MEK/toluene (1:1) | 70 parts |

Further, 5 Mrads of an electron beam accelerated to 175 kV from the coated-surface side under nitrogen gas atmosphere to crosslink and harden the resin layer of the transferable protective layer.

EXAMPLE 9

(dye layer-integrated protective layer transfer film)

A sublimable dye layer and a thermal fusing ink layer and a releasing layer are formed in the same manner as in Example 8. Further, a transferable protective layer comprising a transparent resin layer and an ultraviolet-screening layer and a thermally-adhesive layer were formed in the same manner as in Example 6 to obtain a protective transfer film. An optical whitening agent ("Uvitex O.B." by Ciba-Geigy, Ltd.) was added in the transparent resin layer (0.1 part) and the thermally-adhesive layer (0.15 part) respectively.

Comparative Example 1

A protective layer transfer film of Comparative Example 1 was prepared in the same manner as in Example 1 except that the ultraviolet-screening layer was not formed.

Comparative Example 2

A protective layer transfer film of Comparative Example 2 was prepared in the same manner as in Example 1 except that the ultraviolet-screening layer was not formed and that the coating liquid used for forming the thermally-adhesive resin layer was replaced by a coating liquid having the following formulation.

| Formulation of Coating Liquid for Forming Thermally-Adhesive Resin Layer: | |
|---|---|
| Acrylic resin ("Dianal BR-90" manufactured by Mitsubishi Rayon Engineering Co., Ltd.) | 20 parts |
| Benzotriazole ultraviolet-absorbing agent ("Tinuvin 328" manufactured by CIBA-GEIGY, LTD.) | 1 part |
| MEK/toluene (weight ratio 1:1) | 80 parts |

Comparative Example 3

A protective layer transfer film of Comparative Example 3 was prepared in the same manner as in Example 1 except that the ultraviolet-screening layer was not formed and that the coating liquid used for forming the thermally-adhesive resin layer was replaced by a coating liquid having the following formulation.

| Formulation of Coating Liquid for Forming Thermally-Adhesive Resin Layer: | |
|---|---|
| Acrylic resin ("Dianal BR-90" manufactured by Mitsubishi Rayon Engineering Co., Ltd.) | 20 p arts |
| Benzophenone ultraviolet-absorbing agent ("Chemisoap 112" manufactured by CHEMIPRO KASEI KAISHA, LTD.) | 1 part |
| MEK/toluene (weight ratio 1:1) | 80 parts |

Comparative Example 4

A protective layer transfer film of Comparative Example 4 was prepared in the same manner as in Example 1 except that the ultraviolet-screening layer was not formed and that the coating liquid used for forming the thermally-adhesive resin layer was replaced by a coating liquid having the following formulation.

| Formulation of Coating Liquid for Forming Thermally-Adhesive Resin Layer: | |
|---|---|
| Acrylic resin ("Dianal BR-90" manufactured by Mitsubishi Rayon Engineering Co., Ltd.) | 20 parts |
| Benzotriazole ultraviolet-absorbing agent ("Tinuvin 328" manufactured by CIBA-GEIGY, LTD.) | 10 parts |
| MEK/toluene (weight ratio 1:1) | 70 parts |

Comparative Example 5

Comparative Example 5 is to evaluate the effect of the resin combined with a reactive ultraviolet-absorbing agent by reaction, obtained when the resin is used not in a protective layer transfer film as in the case of the present invention but in the image-receiving layer of an image-receiving sheet.

A sheet of synthetic paper having a thickness of 150 μm ("Yupo FRG-150" manufactured by Oji-Yuka Synthetic Paper Co., Ltd.) was used as the substrate sheet of an image-receiving sheet. A coating liquid for forming a dye-receiving layer having the following formulation was coated by a bar coater onto one surface of the substrate sheet in an amount of 4.0 g/m$^2$ on dry basis, and then dried to form a dye-receiving layer. A heat transfer image-receiving sheet was thus prepared.

| Formulation of Coating Liquid for Forming Dye-Receiving Layer: | |
|---|---|
| Copolymeric resin combined with reactive ultraviolet-absorbing agent by reaction ("UVA-633L" manufactured by BASF JAPAN LTD.) | 20 parts |
| Amino-modified silicone ("X-22-343" manufactured by Shin-Etsu Chemical Co., Ltd.) | 1 part |
| Epoxy-modified silicone ("KF-393" manufactured by Shin-Etsu Chemical Co., Ltd.) | 1 part |
| MEK/toluene (weight ratio 1:1) | 80 parts |

A colored image was transferred to the dye-receiving layer of the above-obtained heat transfer image-receiving sheet in the below-described manner. The protective layer of Comparative Example 1 (protective layer containing no ultraviolet-screening layer) was transferred to the surface of the colored image, and the image covered by the protective layer was evaluated in terms of light resistance and spread in accordance with the test methods which will be described later.

(Transfer of Image and Protective Layer to Card or Image-Receiving Sheet)

A card prepared by using a polyvinyl chloride composition having the following formulation (an image-receiving sheet in the case of Comparative Example 5) was used as an image-receiving material. The dye-coated surface of the above-prepared sublimation-type heat transfer printing film was brought into contact with one surface of the card (the surface of the dye-receiving layer in the case of the image-receiving sheet). To this was applied thermal energy by the thermal head of a printer to which electric signals obtained by the color separation of a photograph of face were connected. A full-colored image was thus obtained.

| Formulation of Polyvinyl Chloride Composition | |
|---|---|
| Polyvinyl chloride compound (degree of polymerization = 800, containing approx. 10% of additives such as stabilizer) | 100.0 parts |
| White pigment (titanium oxide) | 10.0 parts |
| Plasticizer (DOP) | 0.5 parts |

Successively, on the surface of the colored image produced by the sublimable dyes on the above card (the image-receiving sheet in the case of Comparative Example 5), the thermally-transferable resin layer of each of the protective layer transfer films of Examples 1 to 9 and Comparative Examples 1 to 4 was transferred by the thermal head of the same printer as in the above. Further, the thermally-transferable resin layer of the protective layer transfer film of Comparative Example 5 was also transferred by the same manner with the use of the image-receiving sheet of Comparative Example 1. Colored images protected by the protective layer were thus obtained.

(Test Method of Light Resistance of Transferred Image)

The above-obtained cards and image-receiving sheet to which both the colored image and the protective layer were transferred were used as samples for this test. 200 KJ/m$^2$ or 300 KJ/m$^2$ of light was applied to the image-printed surface of each sample by using a xenon fadeometer ("Ci-35A" manufactured by Atlas Corp.). The optical densities of the image before and after the application of light were measured by an optical densitometer ("RD-918" manufactured by Macbeth Corp.), and the retention of the optical density was calculated from the following equation:

Retention of optical density (%)=(optical density after application of light/optical density before application of light)×100

The retentions thus obtained are converted to the following symbols, and shown Table 1 as the results of the light resistance test.

⊙: retention is 80% or higher

○: retention is 70% or higher and lower than 80%

Δ: retention is 60% or higher and lower than 70%

X: retention is lower than 60%

(Test Method of Spread of Transferred Image)

The above-obtained cards and image-receiving sheet to which both the colored image and the protective layer were transferred were used as samples for this test. The samples were preserved at 60° C. for 100 hours, and the images on the samples were visually observed as to whether the images were spread or not, and evaluated in accordance with the following standard. The results are shown in Table 1.

Evaluation Standard:

○: No spread was found in dots

X: Spread was found in dots

TABLE 1

(Results of Light Resistance Test & Spread Test)

| Sample | Retention (%) after application of xenon-lamp exposure | | Spread of image Preserved at 60° C. for |
|---|---|---|---|
| | 200 KJ/m$^2$ | 300 KJ/m$^2$ | 100 hrs. |
| Example 1 | ⊙ | ⊙ | ○ |
| Example 2 | ⊙ | ⊙ | ○ |
| Example 3 | ⊙ | ⊙ | ○ |
| Example 4 | ⊙ | ⊙ | ○ |
| Example 5 | ⊙ | ⊙ | ○ |
| Example 6 | ⊙ | ⊙ | ○ |
| Example 7 | ⊙ | ⊙ | ○ |
| Example 8 | ⊙ | ⊙ | ○ |
| Example 9 | ⊙ | ⊙ | ○ |
| Comparative Example 1 | ○ | X | ○ |
| Comparative Example 2 | ○ | Δ | ○ |
| Comparative Example 3 | ○ | Δ | ○ |
| Comparative Example 4 | ○ | ○ | X |

TABLE 1-continued (Results of Light Resistance Test & Spread Test)

| Sample | Retention (%) after application of xenon-lamp exposure | | Spread of image Preserved at 60° C. for |
|---|---|---|---|
| | 200 KJ/m$^2$ | 300 KJ/m$^2$ | 100 hrs. |
| Comparative Example 5 | ○ | Δ | ○ |

As explained above in detail, a resin which is combined with a reactive ultraviolet-absorbing agent by reaction is used in the thermally-transferable resin layer of the protective layer transfer films of the present invention. The ultraviolet-absorbing agent is therefore hardly vaporized, volatilized or decomposed by heat, or flowed out along with a solvent as compared with a conventional benzotriazole or benzophenone ultraviolet-absorbing agent incorporated into a thermally-transferable resin layer. For this reason, the protective layer transfer films of the invention have such an effect that when the thermally-transferable resin layer is transferred, as a protective layer, to the surface of a thermally-transferred image, image-printed matter excellent in durability such as resistance to abrasion, scratch, light and chemicals can be obtained. In particular, they are remarkably excellent in maintaining the effect of improving the light resistance for a long time. Further, the protective layer transfer films obtained in Examples 6 to 9 shows excellent transferability of the protective layer, and the image-printed matter therewith has good unti-scratch property.

What is claimed is:

1. A protective layer transfer film comprising:

a substrate film, and a thermally-transferable resin layer provided thereon, which comprises a resin combined with a reactive ultraviolet-absorbing agent by reaction.

2. The protective layer transfer film according to claim 1, wherein the resin combined with a reactive ultraviolet-absorbing agent by reaction is a copolymer of a reactive ultraviolet-absorbing agent represented by the formula (I):

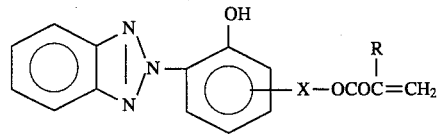

(I)

wherein R is H or $CH_3$, and X is $—CH_2CH_2—$ or $$—CH_2\underset{\underset{OH}{|}}{C}HCH_2—,$$

or by the formula (II):

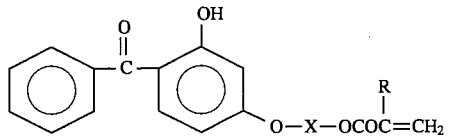

(II)

wherein R is H or $CH_3$, and X is $—CH_2CH_2—$ or $$-CH_2\underset{\underset{OH}{|}}{C}HCH_2-$$

and at least one of thermoplastic resin monomers and oligomers, and reactive polymers.

3. The protective layer transfer film according to claim 2, wherein the copolymer is a copolymer of the reactive ultraviolet-absorbing agent and at least one of acrylic monomers, oligomers and reactive polymers.

4. The protective layer transfer film according to claim 1, wherein the thermally-transferable resin layer comprises a laminate composed of a transparent resin layer and a thermally-adhesive resin layer which are laminated on the substrate film in the mentioned order, and at least one of these resin layers comprises the resin combined with a reactive ultraviolet-absorbing agent by reaction.

5. The protective layer transfer film according to claim 1, wherein the thermally-transferable resin layer comprises a laminate composed of a transparent resin layer and a thermally-adhesive resin layer which are laminated on the substrate film in the mentioned order, and an ultraviolet-screening layer comprising the resin combined with a reactive ultraviolet-absorbing agent by reaction is provided between the transparent resin layer and the thermally-adhesive resin layer.

6. The protective layer transfer film according to claim 1, wherein a sublimable dye layer and/or a thermal fusing ink layer are(is) formed on the substrate film side by side together with the thermally-transferable resin layer.

7. Image-printed matter comprising:

an image-receiving material containing at least an image colored with a dye on the surface thereof, and the thermally-transferable resin layer of the protective layer transfer film of claim 1 laminated on at least a part of the image-printed surface of the image-receiving material.

* * * * *

US005494885C1

(12) EX PARTE REEXAMINATION CERTIFICATE (5777th)

United States Patent

Kudo et al.

(10) Number: US 5,494,885 C1

(45) **Certificate Issued: *Jun. 12, 2007**

(54) PROTECTIVE LAYER TRANSFER FILM AND IMAGE-PRINTED MATTER

(75) Inventors: Mikiko Kudo, Tokyo (JP); Katsuyuki Oshima, Tokyo (JP); Hitoshi Saito, Tokyo (JP)

(73) Assignee: Dai Nippon Printing Co., Ltd., Tokyo-To (JP)

Reexamination Request:
No. 90/007,467, Mar. 16, 2005

Reexamination Certificate for:

| | |
|---|---|
| Patent No.: | **5,494,885** |
| Issued: | **Feb. 27, 1996** |
| Appl. No.: | **08/390,953** |
| Filed: | **Feb. 21, 1995** |

( * ) Notice: This patent is subject to a terminal disclaimer.

(30) Foreign Application Priority Data

Feb. 21, 1994 (JP) ..... 6-44734

(51) Int. Cl.

| | |
|---|---|
| ***B41M 7/00*** | (2006.01) |
| ***B41M 5/46*** | (2006.01) |
| ***B41M 5/40*** | (2006.01) |

(52) U.S. Cl. ..... 503/227; 428/32.39; 428/500; 428/913; 428/914

(58) Field of Classification Search ..... None
See application file for complete search history.

(56) References Cited

U.S. PATENT DOCUMENTS

| | | |
|---|---|---|
| 4,756,963 A | 7/1988 | Yamamoto et al. |
| 5,217,773 A | 6/1993 | Yoshida |

FOREIGN PATENT DOCUMENTS

| | | |
|---|---|---|
| EP | 487 727 A1 | 6/1992 |
| EP | 495 482 A1 | 7/1992 |
| EP | 500 372 A1 | 8/1992 |
| EP | 543 339 A1 | 5/1993 |
| JP | 5-212974 | 8/1943 |
| JP | 62-214990 | 9/1987 |
| JP | 5-170941 | 7/1993 |

*Primary Examiner*—Evelyn Mei Huang

(57) ABSTRACT

A protective layer transfer film comprising a substrate film, and a thermally-transferable resin layer provided thereon, which comprises a resin combined with a reactive ultraviolet-absorbing agent by reaction.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2-7, dependent on an amended claim, are determined to be patentable.

New claims 8-9 are added and determined to be patentable.

1. A protective layer transfer film comprising:

a substrate film, and a thermally-transferable resin layer provided thereon, which comprises a resin combined with a reactive ultraviolet-absorbing agent by reaction*;*

*wherein the protective layer transfer film is configured so that the thermally-transferable resin layer can be transferred from the substrate film to an object during heat transfer printing.*

*8. A protective layer transfer film comprising:*

*a substrate film, and*

*a thermally-transferable resin layer provided on the substrate film, the thermally-transferable resin layer consisting essentially of a reactive ultraviolet-absorbing agent by reaction;*

*wherein the protective layer transfer film is configured so that the thermally-transferable resin layer can be transferred from the substrate film to an object during heat transfer printing.*

*9. A protective layer transfer film comprising:*

*a substrate film, and*

*a thermally-transferable resin layer provided on the substrate film;*

*wherein:*

*the protective layer transfer film is configured so that the thermally-transferable resin layer can be transferred from the substrate film to an object during heat transfer printing*

*the thermally-transferable resin layer comprises a laminate composed of a transparent resin layer and a thermally-adhesive resin layer which are laminated on the substrate film in the mentioned order;*

*at least one of these resin layers comprises the resin combined with a reactive ultraviolet-absorbing agent by reaction; and*

*an amount of reactive ultraviolet-absorbing agent in the thermally-transferable resin layer is not less than 20% by weight.*

* * * * *